US006195519B1

(12) United States Patent
Isobe et al.

(10) Patent No.: US 6,195,519 B1
(45) Date of Patent: Feb. 27, 2001

(54) IMAGE FORMING APPARATUS HAVING POWER AND CONTROL SIGNAL TRANSFER TO A REVOLVER WITHOUT CONTACTING THE REVOLVER

(75) Inventors: Takundo Isobe; Shinji Kato, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/461,399

(22) Filed: Dec. 15, 1999

(30) Foreign Application Priority Data

Dec. 18, 1998 (JP) ..... 10-361310
Dec. 18, 1998 (JP) ..... 10-361311

(51) Int. Cl.[7] ..... G03G 15/01
(52) U.S. Cl. ..... 399/227; 399/88
(58) Field of Search ..... 399/227, 226, 399/223, 228, 229, 88, 90, 37, 75, 167; 307/141.4; 361/235; 340/870.32, 870.31; 336/115

(56) References Cited

U.S. PATENT DOCUMENTS

| | | | | |
|---|---|---|---|---|
| 4,446,461 | * | 5/1984 | Selleck | 340/870.32 |
| 4,697,915 | * | 10/1987 | Hayashi et al. | 399/227 |
| 5,671,470 | | 9/1997 | Maruta et al. | 399/235 |
| 5,826,146 | | 10/1998 | Maruta et al. | 399/235 |
| 5,926,670 | | 7/1999 | Furuta et al. | 399/101 |
| 5,970,278 | | 10/1999 | Munakata | 399/46 |
| 5,983,060 | | 11/1999 | Namekata et al. | 399/297 |
| 6,006,062 | | 12/1999 | Takahashi et al. | 399/310 |
| 6,009,293 | * | 12/1999 | Takami | 399/227 |

FOREIGN PATENT DOCUMENTS

| | | |
|---|---|---|
| 6-267627 | 9/1994 | (JP) . |
| 8-69144 | 3/1996 | (JP) . |
| 8-88600 | 4/1996 | (JP) . |
| 10-133446 | 5/1998 | (JP) . |
| 11-174797 | 7/1999 | (JP) . |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes an apparatus body and a rotary developing unit or revolver. The apparatus body includes a connection unit having a single optical transmission/receipt section. The revolver includes a connection unit having four optical transmission/receipt sections arranged at the intervals of 90 degrees in the circumferential direction of the revolver. All the transmission/receipt sections are spaced from the axis of the revolver by the same distance. When the revolver is brought to a stop at a preselected developing position, one of the four transmission/receipt sections of the revolver faces the transmission/receipt section of the apparatus body without fail. The connection units include a current transformer for feeding power from the apparatus body to the developing unit. The connection units face each other at parallel surfaces thereof.

12 Claims, 8 Drawing Sheets

IMAGE FORMING APPARATUS HAVING POWER AND CONTROL SIGNAL TRANSFER TO A REVOLVER WITHOUT CONTACTING THE REVOLVER

BACKGROUND OF THE INVENTION

The present invention relates to a copier, printer, facsimile apparatus or similar image forming apparatus and more particularly to an image forming apparatus including a revolver type developing unit.

An electrophotographic process using powdery toner for developing an image and an apparatus for practicing the same are conventional. For example, a monocolor or a full-color image forming apparatus of the type using two-ingredient type developers usually includes sensors each for sensing the toner content of a particular developer, i.e., so-called T sensors. This type of apparatus executes process control in accordance with the outputs of the T sensors in order to enhance image quality.

It is a common practice with, e.g., a color image forming apparatus to use a rotary developing unit (revolver hereinafter) having a plurality of developing sections arranged therein. The problem with this kind of apparatus is that leads, for example, cannot be connected to the revolver. It follows that even if sensors and other electrical loads are arranged in the revolver, signals output form the loads cannot be sent to the body of the apparatus. The apparatus therefore fails the execute sufficient process control.

In light of the above, Japanese Patent Laid-Open Publication No. 8-69144, for example, discloses an image forming apparatus using photoelectric transducers for feeding power to a revolver and receiving information from the revolver. Also, Japanese Patent Laid-Open Publication No. 10-133446 teaches the use of a current transformer for feeding power and the use of optical communication for interchanging signals.

However, the photoelectric transducer scheme cannot maintain an electromotive force derived from the emission of light stable due to the rotation of the revolver, resulting in unstable generation of power in the revolver. Further, the quantity of light available with a light source and therefore the electromotive force sequentially decreases due to the limited life of the light source. In addition, the light source emitting light within the apparatus body effects a photoconductive element or image carrier. Even the current transformer and optical communication scheme renders the power feed and signal interchange unstable due to the rotation of the revolver and is apt to obstruct the transfer of necessary signals.

Technologies relating to the present invention are also disclosed in, e.g., Japanese Patent Laid-Open Publication Nos. 6-267627, 8-88600, and 11-174797.

SUMMARY OF THE INVENTION

It is therefore an object of the present invention to provide an image forming apparatus realizing sure signal transfer and stable power feed between a revolver and an apparatus body.

In accordance with the present invention, an image forming apparatus including a revolver type developing unit rotatable with a plurality of developing sections arranged therein, and controlling electrical loads arranged in the developing unit without contacting the developing unit includes an apparatus body and power transfer sections respectively included in the developing unit and apparatus body for feeding power from the apparatus body to the developing unit without contacting each other. The power transfer sections are arranged such that when the developing unit is brought to a stop at a preselected developing position, the power transfer sections face each other.

Also, in accordance with the present invention, an image forming apparatus of the type described includes an apparatus body and connection units respectively included in the apparatus body and developing unit and each including a power feed section and a signal transmission/receipt section. The connection units face each other at parallel surfaces thereof.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter. In the illustrative embodiments, the image forming apparatus is implemented as a color image forming apparatus with a rotary developing unit or revolver by way of example.

Figure 1:
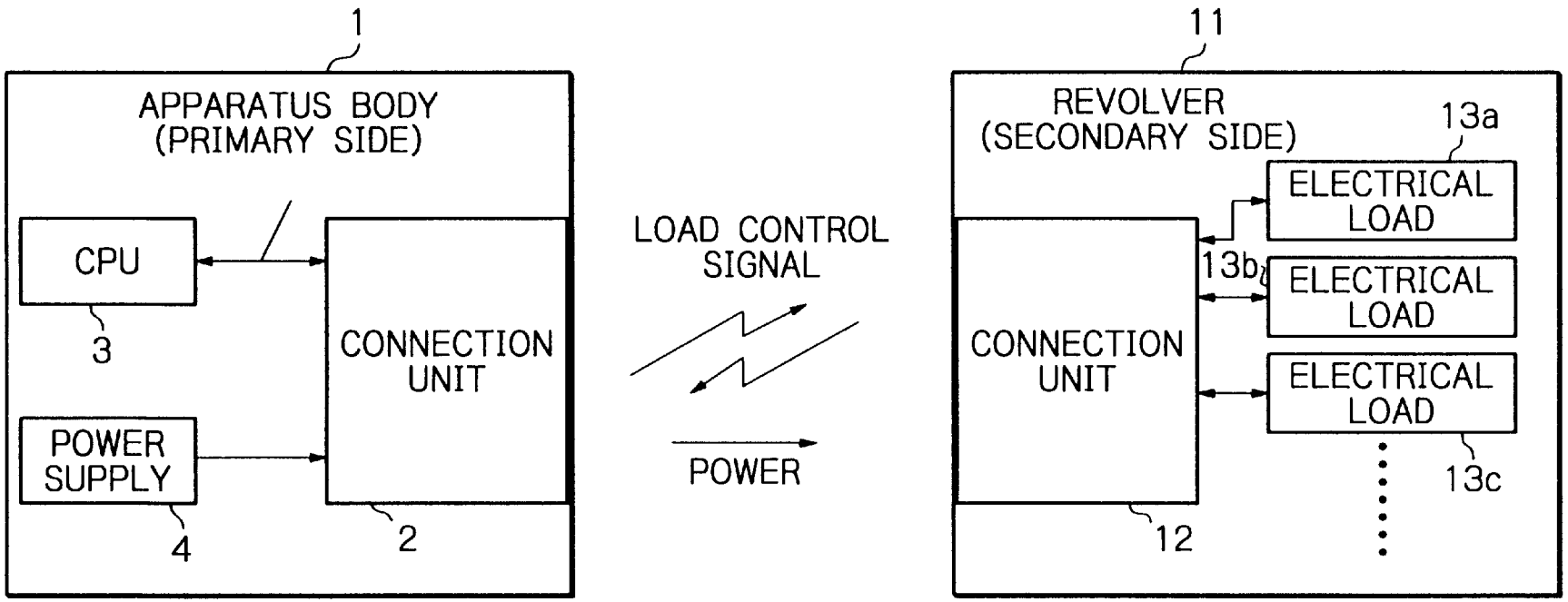
FIG. 1 is a block diagram schematically showing an image forming apparatus embodying the present invention, particularly a specific arrangement for effecting power feed and signal transfer between an apparatus body and a revolver.

Referring to FIG. 1 of the drawings, an image forming apparatus embodying the present invention is shown in a schematic block diagram. A revolver included in the illustrative embodiment has a holder-like frame rotatable about a single shaft and four developing sections affixed to the frame and each being assigned to particular one of four different colors. The frame is rotated to bring desired one of the developing sections to a preselected developing position where it faces an image carrier not shown.

Specifically, FIG. 1 shows a specific arrangement for implementing power feed and signal transfer between the body of the image forming apparatus and the revolver without causing them to contact each other. As shown, the apparatus body and revolver, respectively labeled 1 and 11, include connection units 2 and 12, respectively. The connection units 2 and 12 are constructed to allow the apparatus body 1 to transfer power and control signals to the revolver 11 without contacting the revolver 11. Let the connection units 2 and 12 included in the body 1 and revolver 11 be referred to as a primary connection unit and a secondary connection unit, respectively. A power supply 4 included in the apparatus body 1 feeds DC power to the primary connection unit 2.

A CPU (Central Processing Unit) 3 for main control is also included in the apparatus body 1 and controls the entire apparatus body 1. The CPU 3 generates load control signals for controlling electrical loads 13*a,* 13*b,* 13*c* and so forth included in the revolver 11. Further, the CPU 3 receives signals fed back from the electrical loads 13*a,* 13*b,* 13*c* and so forth of the revolver 11.

The apparatus body 1 feeds power to the revolver 11 without contacting it in order to drive the electrical loads 13*a*–13*c,* e.g., switches and sensors of the revolver 11. Also, the apparatus body 1 controls such electrical loads without contacting the revolver 11. The CPU 3 is therefore capable of controlling the structural elements of the revolver 11 and obtaining information from the revolver 11 without contacting the revolver 11.

Figure 2:
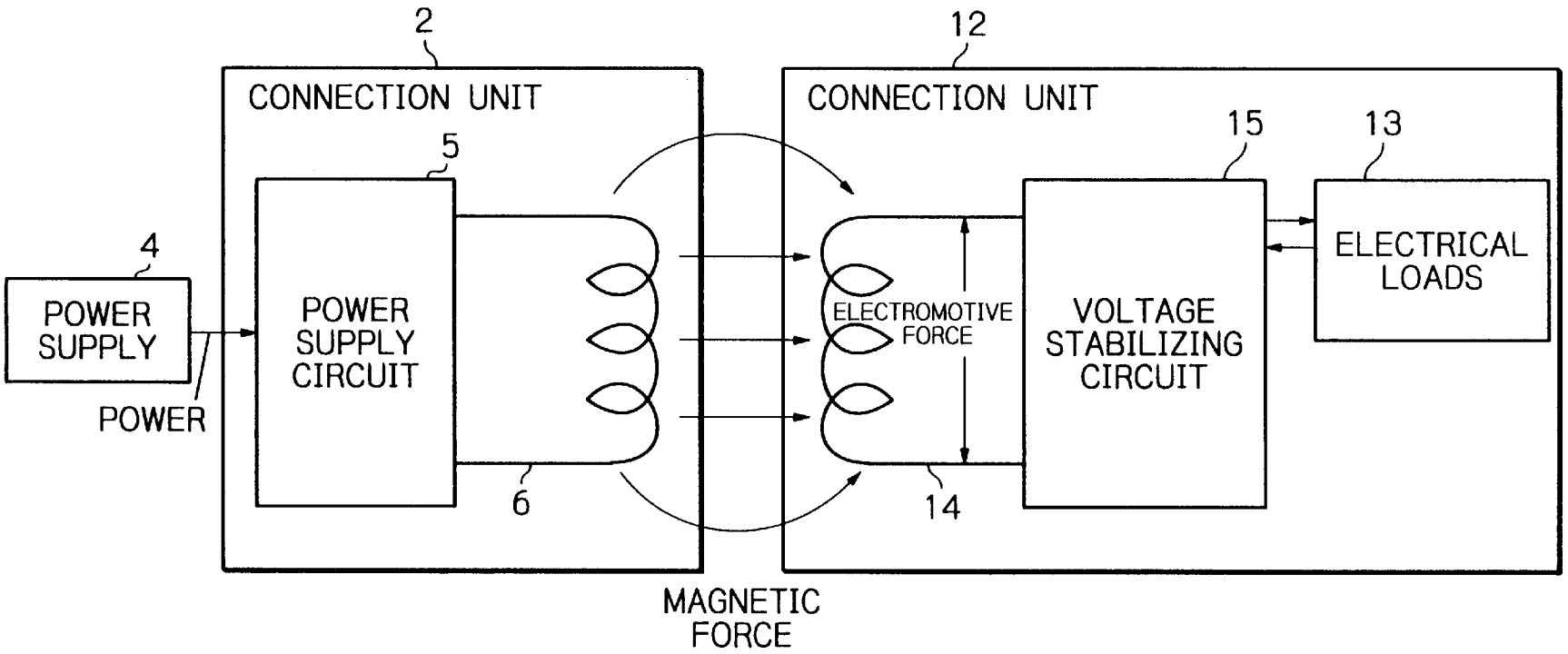
FIG. 2 is a schematic block diagram showing a current transformer for feeding power to the revolver.

FIG. 2 schematically shows a current transformer or power transferring means for feeding power from the apparatus body 1 to the revolver 11 via the two connection units 2 and 12. As shown, the primary connection unit 2 and secondary connection unit 12 respectively include a primary winding 6 and a secondary winding 14 facing each other. A power supply circuit 5 is connected to the primary winding 6. The power supply 4 feeds DC power to the power supply circuit 5. The power supply circuit 5 executes, e.g., chopping control in order to efficiently generate an electromagnetic power meant for the secondary side.

When a current flows through the primary winding 6, an electromagnetic force is generated in the winding 6. The secondary winding 14 receives the electromagnetic force with the result that an electromotive force is generated between opposite ends of the winding 14. A voltage stabilizing circuit (secondary side output stabilizing circuit) 15 is connected to the winding 14 in order to further stabilize the electromotive force. The stabilized power is input to the electrical loads, generally 13, and drives them. The primary winding 6 is affixed to the apparatus body 1 while the secondary winding 14 is affixed to the revolver 11 and rotatable together with the revolver 11.

Figure 3:
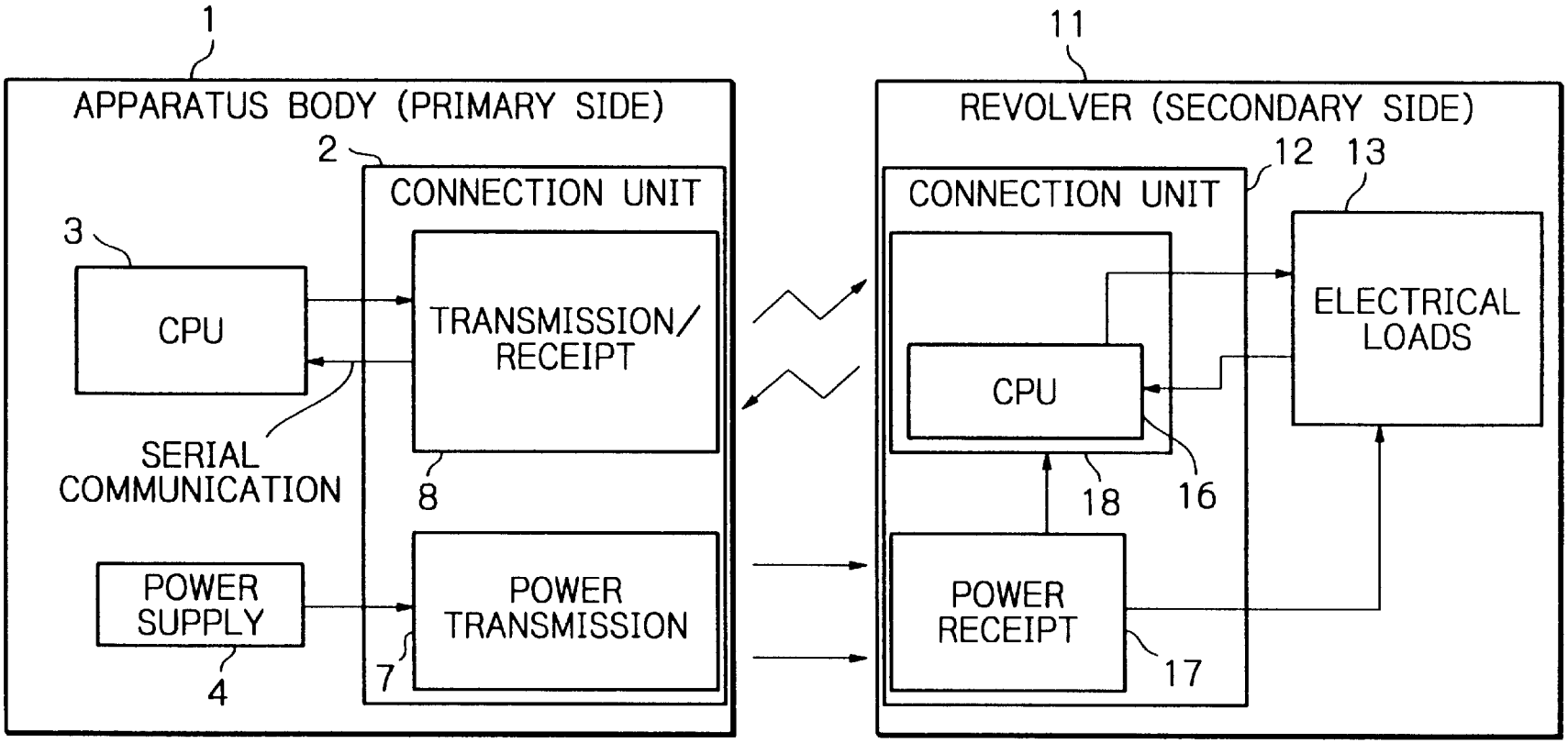
FIG. 3 is a schematic block diagram showing signal transfer implemented by optical communication.

FIG. 3 shows a specific construction in which signal transfer between the primary connection unit 2 and the secondary connection unit 12 is implemented by optical communication. As shown, the primary connection unit 2 includes a power transmission 7 and a transmission/receipt 8 for optical communication. The secondary connection unit 12 includes a power receipt 17 and a transmission/receipt 18 for optical communication. The transmission/receipts 8 and 18 each include a light emitting portion and a light-sensitive portion; when one of them emits light, the other of them receives the light. The light emitting portion and light-sensitive portion may be implemented by an LED (Light Emitting Diode) and a phototransistor, respectively.

When the CPU 3 delivers a control signal to the transmission/receipt 8 by serial communication, the transmission/receipt 8 transforms the control signal to an optical signal and drives the light emitting portion with the optical signal. The transmission/receipt 18 of the secondary side receives the resulting emission from the primary side and transforms it to an electric signal. The electric signal is delivered from the transmitter/receiver 18 to a load control CPU 16 included in the revolver 11. The load control CPU 16 controls preselected one of the electrical loads 13 in accordance with the input electric signal. The signal transfer to the CPU 16 refers to the transfer of electric signals using a conventional wiring harness.

A signal fed back from the electrical load 13 is input to the transmission/receipt 18 via the CPU 16. The transmission/receipt 18 transforms the input signal to an optical signal and sends it to the primary side by serial communication. The transmission/receipt 8 of the primary side receives the optical signal, transforms it to an electric signal, and delivers the electric signal to the CPU 3.

As stated above, the CPU 3 included in the apparatus body 1 receives information relating to the electrical loads of the revolver 11 not contacting the apparatus body 1 and controls the electrical loads of the revolver 11.

Figure 4:
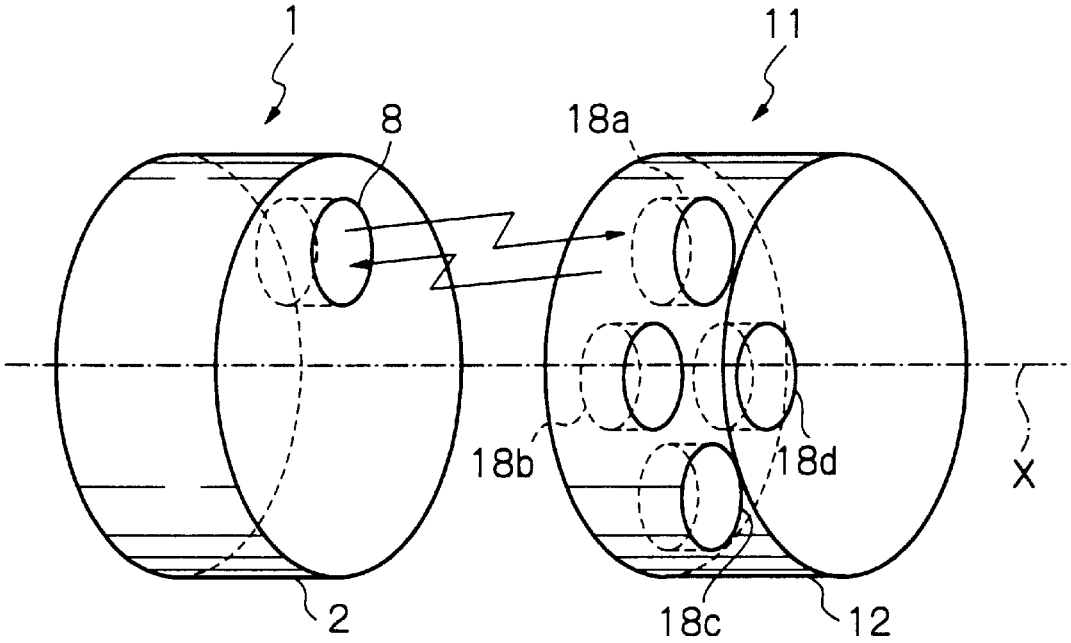
FIGS. 4 through 6 are perspective views each showing a particular layout of transmission/receipt sections for optical communication included in connection units.

The connection units 2 and 12 included in the apparatus body 1 and revolver 11, respectively, are capable of interchanging signals by use of a current transformer or optical communication, as stated above specifically. As shown in FIG. 4, in the illustrative embodiment, while the connection unit 2 includes a single optical transmission/receipt 8, the connection unit 12 includes four optical transmission/receipts 18*a*–18*d.* The connection unit 12 is located at the center of the revolver 11. The four transmission/receipts 18*a*–18*d* are arranged at the same distance from the axis of rotation x of the revolver 11 at the intervals of 90 degrees in the circumferential direction of the revolver 11. The transmission/receipt 8 of the apparatus body 1 is spaced from the axis x by a distance equal to the distance between the transmission/receipts 18*a*–18*d* and the axis x. The transmission/receipts 18*a*–18*d* are laid out on the revolver 11 such that one of them faces the transmission/receipt 8 of the apparatus body 1 when the revolver 11 is brought to a stop.

More specifically, in the illustrative embodiment, the four developing sections each being assigned to a particular color are arranged in the revolver 11 at the intervals of 90 degrees in the circumferential direction of the revolver 11. Therefore, to bring any one of the developing sections to the developing position, the revolver 11 is rotated by an integral multiple of 90 degrees. It follows that when the revolver 11 is brought to a stop at the developing position, one of the four transmission/receipts 18*a*–18*d* thereof faces the transmission/receipt 8 of the apparatus body 1 without fail. In this condition, the transmission/receipt 8 and one of the transmission/receipts 18*a*–18*d* can optically communicate with each other. This insures signal interchange between the apparatus body 1 and the revolver 11.

In FIG. 4, the transmission/receipt 18*a* of the revolver 11 is shown as facing the transmission/receipt 8 of the apparatus body 1. When the revolver 11 is rotated, e.g., clockwise by 90 degrees from the position shown in FIG. 4, the transmission/receipt 18*b* faces the transmission/receipt 8. This is also true with the other transmission/receipts 18*c* and 18*d*.

The electrical loads 13 of the revolver 11 may include T sensors responsive to the toner contents of developers stored in the developing sections of the revolver 11. In the illustrative embodiment, when the revolver 11 is brought to a stop at the developing position during image formation, the outputs of the T sensors can be sent to the apparatus body 1. It is therefore possible to execute sure process control and thereby output high quality images. Of course, any other electrical loads can be controlled in the same manner as the T sensors.

As for power transfer of FIG. 2 using the current transformer, the connection units 2 and 12 of the apparatus body 1 and revolver 11 may also be provided with a single power transmission 7 and four power receipts 17, respectively. In such a case, the power transmissions 7 and 17 will be arranged in the same manner as the above optical transmission/receipts 8 and 18*a*–18*d*. This configuration is also successful to insure stable power feed from the apparatus body 1 to the revolver 11.

In the specific configuration shown in FIG. 4, the apparatus body or primary side 1 includes a single transmission/receipt section and a single power transmission section while the revolver or secondary side 11 includes four transmission/receipt sections and four power receipt sections. Alternatively, the primary side 1 and secondary side 11 may be respectively provided with four transmission/receipt sections and four power transmission sections and a single transmission/receipt section and a single power receipt section.

Figure 5:
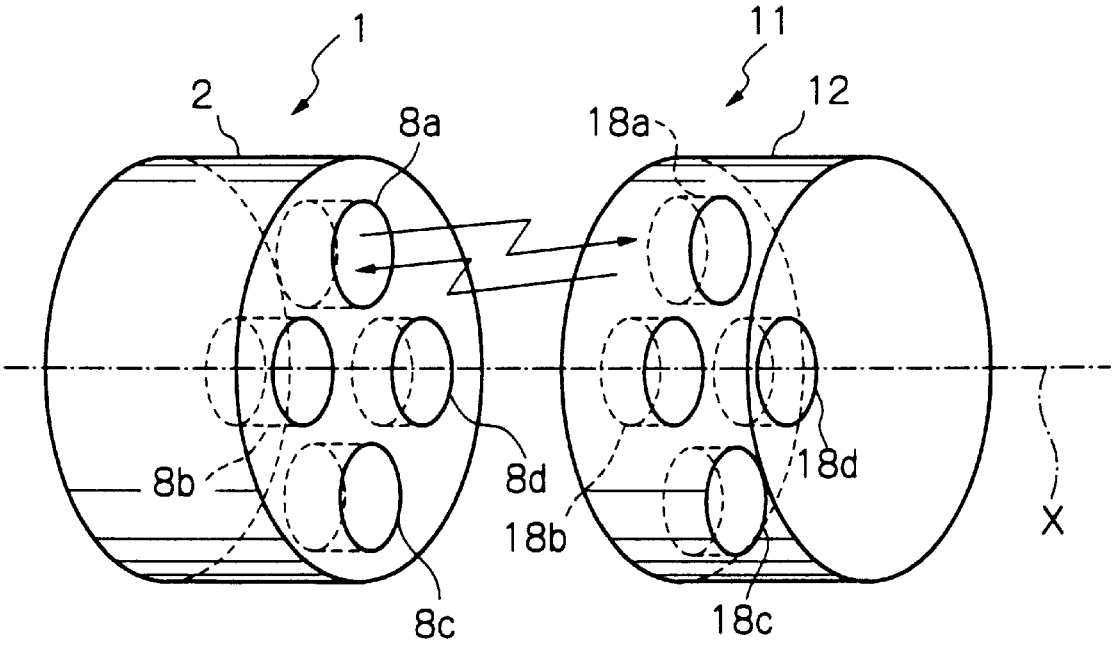

Further, as shown in FIG. 5, four optical transmission/receipts 8*a*–8*d* and four optical transmission/receipts 18*a*–18*d* may be arranged in the apparatus body 1 and revolver 11, respectively. In addition, four power transmission sections may be arranged in each of the apparatus body 1 and revolver 11. Moreover, to reduce the size of the connection units, the apparatus body 1 may include a single optical transmission/receipt section and four power transmission sections while the revolver 11 may include four optical transmission/receipt sections and a single power receipt section.

In the illustrative embodiment, the apparatus body 1 and/or the revolver 11 is assumed to have four optical transmission/receipt sections, four power transmission sections or four power receipt sections because the apparatus includes four developing sections. If the apparatus includes three developing sections assigned to three different colors, then the apparatus body 1 and/or the revolver 11 may be provided with three optical transmission/receipt sections or three power transfer sections. Of course, any desired number of communicating sections or power transfer sections may be arranged so long as they can face each other when the revolver 11 is brought to a stop.

In the specific configurations shown in FIGS. 4 and 5, the connection units 2 and 12 each have a cylindrical section and have the communication section or sections arranged in the sectional plane. Alternatively, the communicating section or sections may be arranged on the circumference of the cylindrical configuration so long as the communication sections of the apparatus body 1 and revolver 11 are arranged to face each other.

Figure 6:
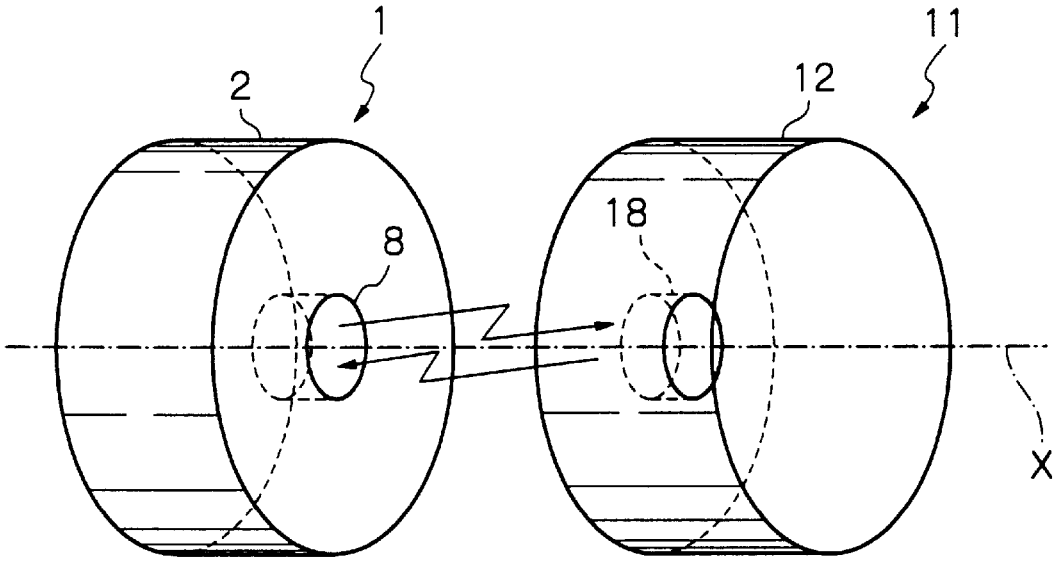

FIG. 6 shows a modification of the illustrative embodiment. As shown, the apparatus body 1 has a single optical transmission/receipt 8 at the center of the connection unit 2 aligning with the axis x of the revolver 11. The revolver 11 also has a single optical transmission/receipt 18 at the center of the connection unit 12, i.e., on the axis x thereof. The transmission/receipts 8 and 18 constantly face each other and can therefore interchange signals any time without regard to whether or not the revolver 11 is in rotation.

Further, the apparatus body 1 of the above modification has a single power transmission 7 at the center of the connection unit 2 aligning with the axis x of the revolver 11, although not shown specifically. Likewise, the revolver 1 has a single power receipt 17 at the center of the connection unit 12, i.e., on the axis x thereof. The power transmission 7 and power receipt 17 constantly face each other and implement power transfer any time without regard to whether or not the revolver 11 is in rotation. For example, the CPU included in the revolver 11 may be caused to operate at any desired time.

Figure 7:
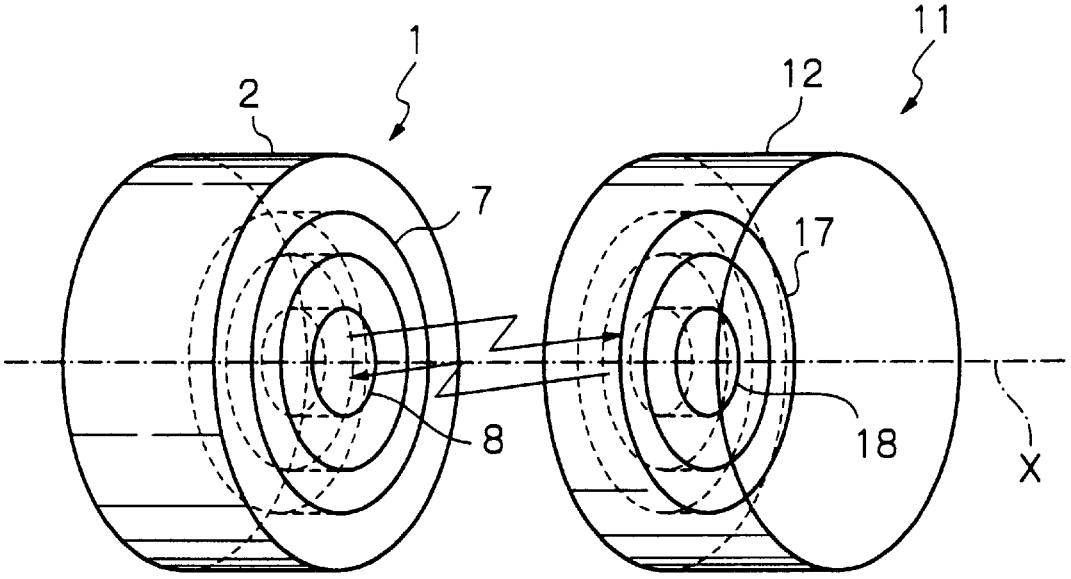
FIG. 7 is a perspective view showing a specific layout of transmission/receipt sections for optical communication and power transfer sections included in the illustrative embodiment.

Another modification of the illustrative embodiment will be described with reference to FIG. 7. As shown, the apparatus body 1 has a single optical transmission/receipt 8 at the center of the connection unit 2 aligning with the axis x of the revolver 11. Likewise, the revolver 11 has a single optical transmission/receipt 18 at the center of the connection unit 12, i.e., on the axis x thereof. An annular power transmission or power transfer 7 and an annular power receipt or power transfer 17 are arranged around the transmission/receipts 8 and 18, respectively. The power transmission 7 and power receipt 17 constantly face each other, so that power can be constantly fed form the apparatus body 1 to the revolver 11. In addition, the transmission/receipts 8 and 18 also constantly face each other and can interchange signals any time. To form such an annular power transfer section, a coil may be wound round an annular core in the form of a ring.

Figure 8:
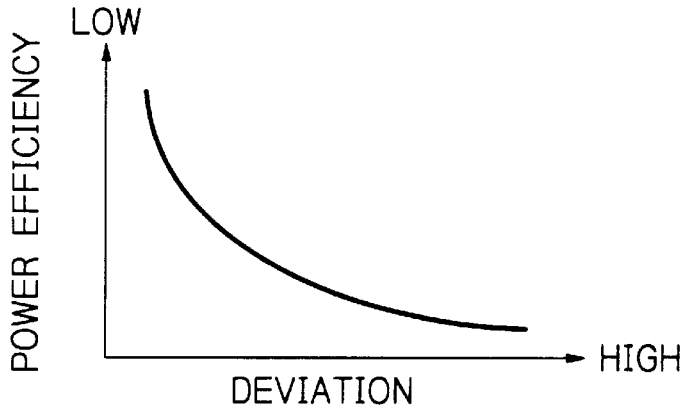
FIG. 8 is a graph showing a relation between the deviation of the center of an annular power transfer section included in the illustrative embodiment and power feed efficiency.

When the above annular power transfer sections have their centers deviated from each other, power feed efficiency decreases. FIG. 8 shows a relation between the deviation between the centers of the power transfer sect ions and the power feed efficiency. Also, any deviation between the centers of the optical transmission/receipt sections degrades communication quality. The transmission/receipts sections 8 and 18 and power transfer sections 7 and 17 arranged concentrically around the axis x of the revolver 11, as shown in FIG. 7, optimize communication quality and power feed efficiency and thereby further promote sure signal transfer and stable power feed.

In FIGS. 4–7, while the connection units each are shown as having a cylindrical configuration, such a configuration is only illustrative. This is also true with the configuration of the optical transmission/receipt sections. The T sensor described is only a specific form of an electrical load included in the revolver and may be replaced with, e.g., any other sensor or a switch. The illustrative embodiment and its modifications are similarly applicable to the drive and control of, e.g., a motor mounted on the revolver. The developers stored in the developing sections of the revolver may be either one of one-ingredient type developers and two-ingredient type developers.

As stated above, the above embodiment and its modifications have the following unprecedented advantages (1) through (6).

(1) When the revolver is brought to a stop at the developing position, signal transfer sections respectively included in the revolver and apparatus body face each other and allow signals to be surely interchanged between the apparatus body and the revolver. For example, the apparatus body can execute process control in response to the outputs of T sensors and output a high quality image.

(2) Because the signal transfer sections are arranged on the axis of the revolver, they constantly face each other without regard to whether or not the revolver is in rotation and implement stable signal interchange any time.

(3) When the revolver is brought to a stop at the developing position, the power transfer sections respectively included in the revolver and apparatus body face each other and realize stable power feed from the apparatus body to the revolver at all times.

(4) Because the power transfer sections are arranged on the axis of the revolver, they constantly face each other without regard to whether or not the revolver is in rotation and implement stable signal interchange any time.

(5) The power transfer sections each having an annular configuration are arranged around the associated signal transfer sections positioned on the axis of the revolver. This insures signal transfer and power feed at all times.

(6) The signal transfer sections and power transfer sections are arranged concentrically around the axis of the revolver. This optimizes communication quality and power feed efficiency and thereby further promotes sure signal transfer and stable power feed.

Figure 9:
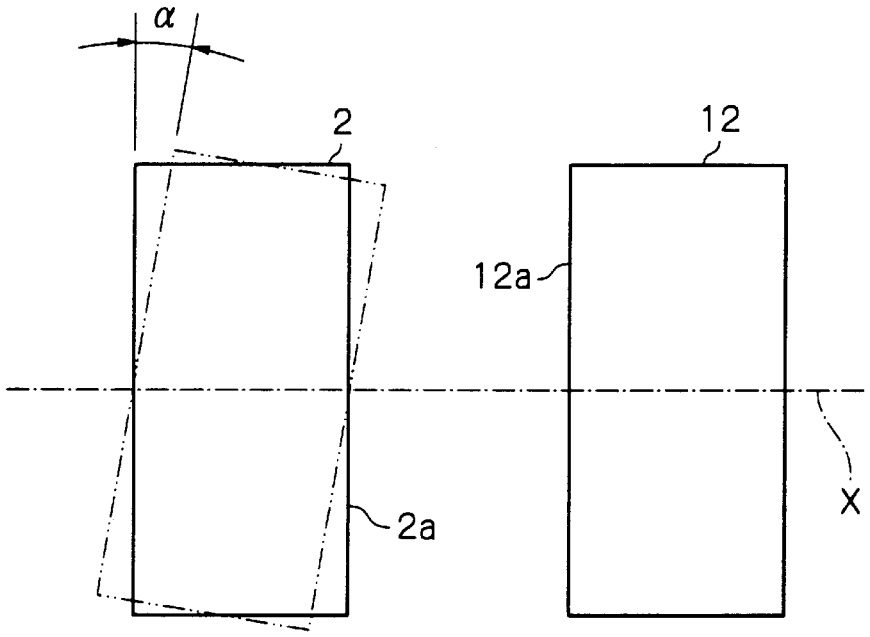
FIG. 9 is a side elevation showing an alternative embodiment of the present invention.

Referring to FIG. 9, an alternative embodiment of the present invention will be described. Arrangements included in the illustrative embodiment for implementing power feed and signal transfer between the apparatus body and the revolver are identical with the arrangements of the previous embodiment and will not be described specifically in order to avoid redundancy.

As shown in FIG. 9, the connection units 2 and 12 included in the apparatus body 1 and revolver 11, respectively, face each other at parallel surfaces 2*a* and 12*a* thereof. Assume that the connection unit 2, for example, is inclined by an angle a relative to the connection unit 12, as illustrated. Then, power transfer efficiency from the primary side to the secondary side decreases because the efficiency with which the secondary winding receives magnetic lines of force output from the primary side decreases because of the principle of the current transformer.

Figure 10:
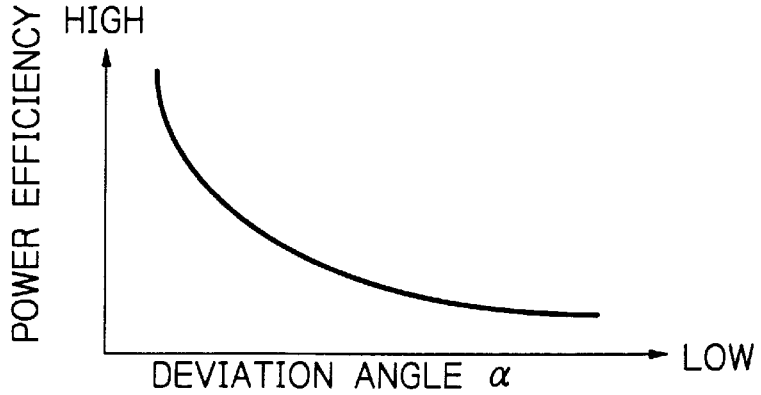
FIG. 10 is a graph showing a relation between a deviation angle between the facing surfaces of connection units included in the embodiment of FIG. 9 and power efficiency.
Figure 11:
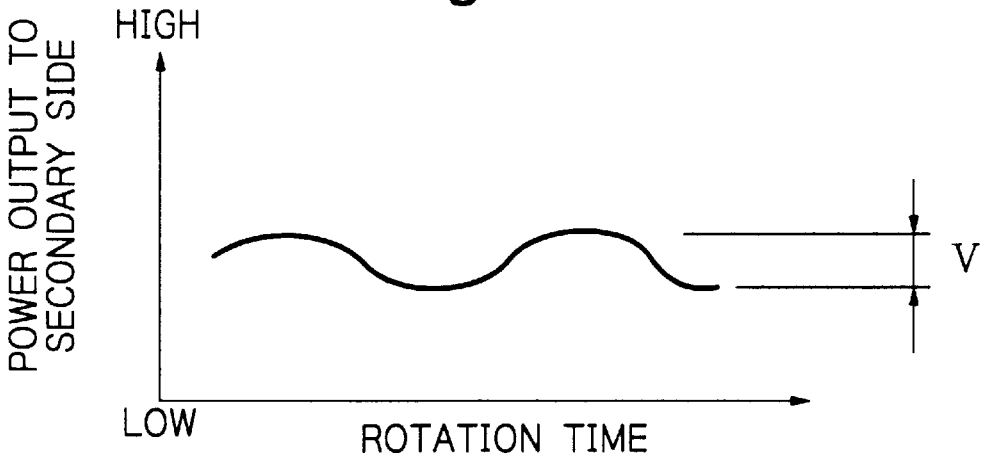
FIG. 11 is a graph showing how the deviation causes power output to the secondary side to vary during the rotation of the revolver.

FIG. 10 is a graph showing a relation between the above angle $\alpha$ and the power efficiency. As FIG. 10 indicates, the power efficiency decreases with an increase in the angle $\alpha$. FIG. 11 shows how the angle $\alpha$ causes power output to the secondary side to vary during the rotation of the revolver 11. As shown, the angle $\alpha$ varies the distance between the primary and secondary windings during the rotation of the revolver 11 and thereby renders the output voltage unstable (V, FIG. 11).

In the illustrative embodiment, the surface 2*a* of the connection unit 2 and the surface 12*a* of the connection unit 12 are parallel to each other. This maintains the distance between the primary and secondary windings of the current transformer constant and thereby enhances the power feed efficiency, i.e., allows stable power to be generated at the secondary side.

Figure 12:
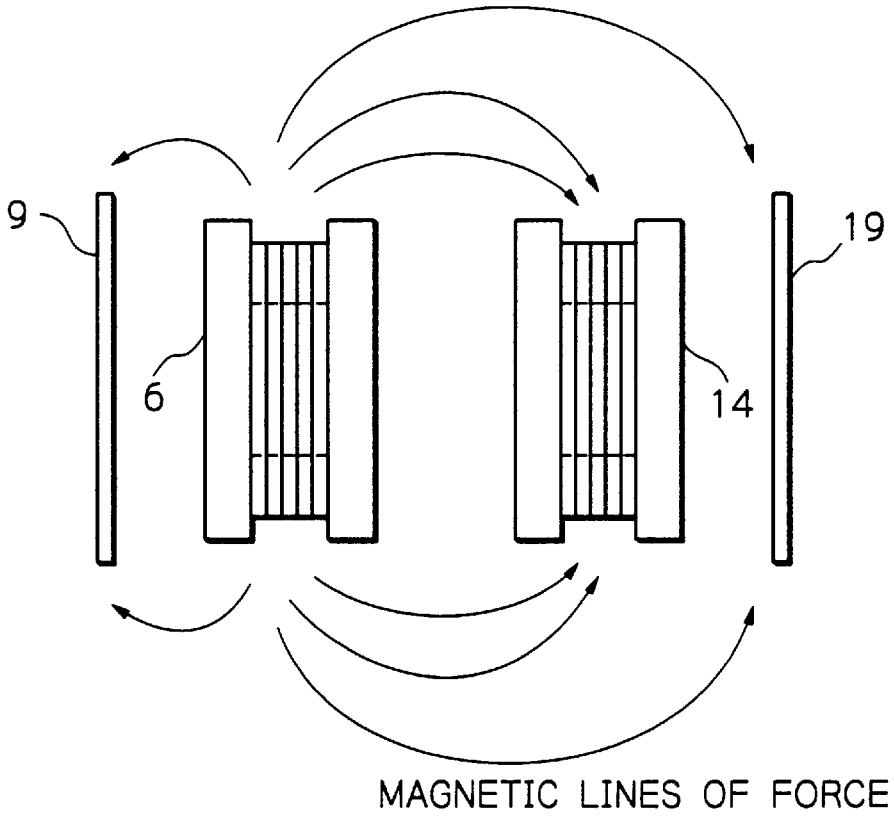
FIG. 12 is a view showing magnetic lines of force appearing in a current transformer included in the embodiment of FIG. 9.
Figure 13:
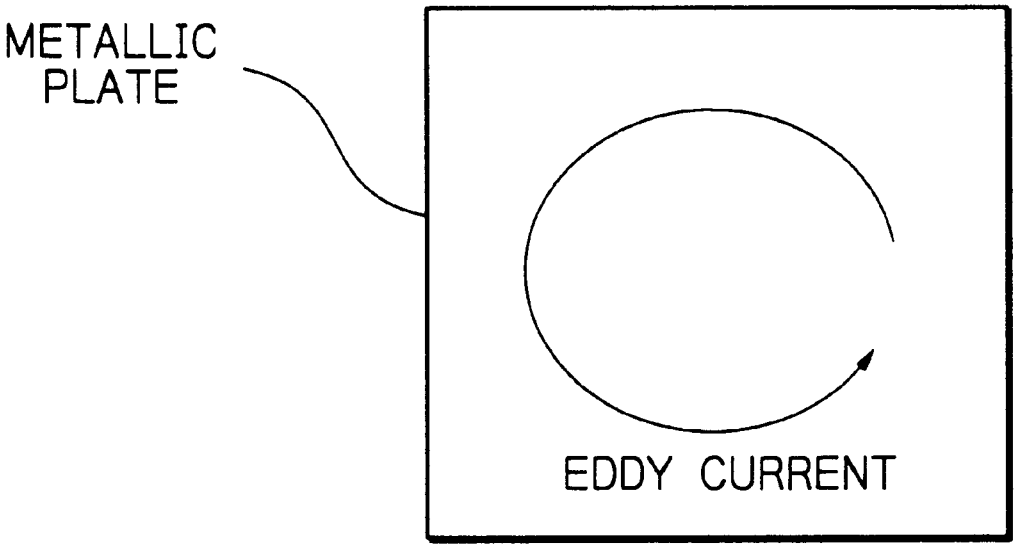
FIG. 13 is a view showing an eddy current flowing through a rectangular metallic plate.

FIG. 12 shows magnetic lines of force extending out from the primary winding of the current transformer. It is to be noted that the primary and secondary windings 6 and 14 each are circular when seen from the front (from one side in FIG. 12). As shown, metallic plates 9 and 19 are sometimes positioned in the vicinity of and in parallel to the windings 6 and 14, respectively. The metallic plates 9 and 19 may be a unit case and a frame by way of example. In this condition, the magnetic lines of force output form the primary winding 6 act on the plates 9 and 19 as well and generate an eddy current in each plate. FIG. 13 shows an eddy current flowing through a rectangular metal plate specifically. Consequently, the number of magnetic lines of force to reach the secondary winding 14 decreases and therefore the power transfer efficiency decreases.

Figure 14:
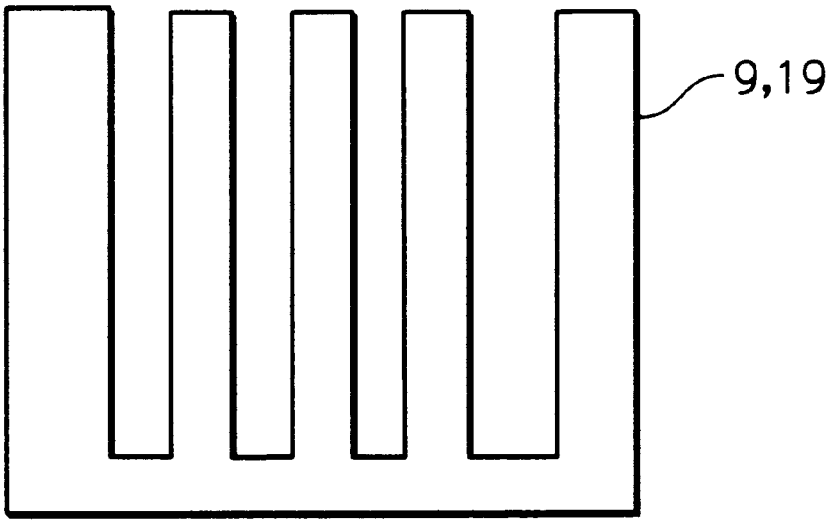
FIG. 14 is a plan view of a metallic plate adjoining a wiring included in the embodiment of FIG. 9.

In light of the above, as shown in FIG. 14, the metallic plates 9 and 19 adjoining the primary and secondary windings 6 and 14, respectively, each are provided with a comb-like configuration. This is successful to reduce the area of each metallic plate through which the eddy current flows, i.e., to increase the number of magnetic lines of force to reach the secondary winding 14. As a result, greater power can be stably generated at the secondary side (revolver 11 side) of the current transformer. The comb-like configuration shown in FIG. 14 is only illustrative and may be suitably modified so long as the above condition is satisfied. Further, the comb-like configuration may even be replaced with any other suitable configuration capable of preventing a current from flowing therethrough in the form of a loop.

When a printed circuit board adjoins the windings 6 and 14 of the current transformer, the fall of power transfer efficiency ascribable to an eddy current also occurs, depending on patterns provided on the printed circuit board. Generally, a ground pattern and a power supply pattern provided on a printed circuit board are implemented as solid patterns. An eddy current generated in any one of such patterns often lowers the power transfer efficiency. In light of this, the ground pattern and power supply pattern each may be provided with a comb-like configuration in order to prevent the number of magnetic lines of force to reach the secondary winding 14 from decreasing.

Again, the illustrative embodiment is capable of implementing sure signal transfer and stable power transfer even when use is made of a one-ingredient type developer.

As stated above, the illustrative embodiment enhances power feed efficiency and allows more stable power to be fed to the secondary side (revolver side) because the surfaces of the connection units facing each other are parallel. Further, the power feed sections of the connection units are implemented by a current transformer including windings. This, coupled with the fact that metal plates parallel to the windings are so configured as to prevent a current from flowing therethrough in the form of a loop, further stabilizes power to be output at the secondary side of the transformer.

Various modifications will become possible for those skilled in the art after receiving the teachings of the present disclosure without departing from the scope thereof.

What is claimed is:

1. An image forming apparatus including a revolver type developing unit rotatable with a plurality of developing sections arranged therein, and controlling electrical loads arranged in said developing unit without contacting said developing unit, said image forming apparatus comprising:

an apparatus body;

power transfer sections respectively included in said developing unit and said apparatus body for feeding power from said apparatus body to said developing unit without contacting each other; and a control arrangement configured to cause stopping of rotation of the rotatable unit at preselected developing positions, wherein said power transfer sections are arranged to include at least one power transfer section on the apparatus body that is in facing alignment with at least one of plural power transfer sections on the developing unit when said developing unit is brought to a stop at a preselected developing position by said control arrangement.

2. An image forming apparatus including a revolver type developing unit rotatable with a plurality of developing sections arranged therein, and controlling electrical loads arranged in said developing unit without contacting said developing unit, said image forming apparatus comprising:

an apparatus body; and power transfer sections respectively included in said developing unit and said apparatus body for feeding power from said apparatus body to said developing unit without contacting each other, wherein said power transfer sections are positioned on an axis of rotation of said developing unit.

3. An image forming apparatus including a revolver type developing unit rotatable with a plurality of developing sections arranged therein, and controlling electrical loads arranged in said developing unit without contacting said developing unit, said image forming apparatus comprising;

an apparatus body;

power transfer sections respectively included in said developing unit and said apparatus body for feeding power from said apparatus body to said developing unit without contacting each other; and signal transfer sections respectively included in said apparatus body and said developing unit, each of said signal transfer sections being configured to interchange signals in two way communications between both said apparatus body and said developing unit without contacting each other, wherein said power transfer sections are arranged such that when the developing unit is brought to a stop at a preselected developing position, said power transfer sections face one another, and said signal transfer sections are also arranged such that when said developing unit is brought to a stop at a preselected developing position, said signal transfer sections face each other.

4. The apparatus as claimed in claim 3, wherein said signal transfer sections are positioned on an axis of rotation of said developing unit.

5. The apparatus as claimed in claim 3, wherein said signal transfer sections are positioned on an axis of rotation of said developing unit, said power transfer sections each having an annular configuration surrounding an associated one of said signal transfer sections.

6. The apparatus as claimed in claim 3, wherein each of said signal transfer sections and an associated one of said power transfer sections are arranged concentrically around an axis of rotation of said developing unit.

7. An image forming apparatus including a revolver type developing unit rotatable with a plurality of developing sections arranged therein, and controlling electrical loads arranged in said developing unit without contacting said developing unit, said image forming apparatus comprising:

an apparatus body; and connection units respectively included in said apparatus body and said developing unit and each including a power feed section and a signal transmission and receiving section, wherein said signal transmission and receiving sections all send and receive transmissions and said connection units are arranged to face each other at parallel surfaces thereof.

8. The apparatus as claimed in claim 7, wherein power feed sections of said connection units constitute a current transformer including windings.

9. The apparatus as claimed in claim 8, further comprising a printed circuit board parallel to said windings of said power feed sections.

10. The apparatus as claimed in claim 9, wherein said printed circuit board has a comb-like pattern formed thereon.

11. An image forming apparatus including a revolver type developing unit rotatable with a plurality of developing sections arranged therein, and controlling electrical loads arranged in said developing unit without contacting said developing unit, said image forming apparatus comprising;

an apparatus body; and connection units respectively included in said apparatus body and said developing unit and each including a power feed section and a signal transmission/receipt section, said connection units facing each other at parallel surfaces thereof, wherein power feed sections of said connection units are formed as a current transformer including windings and further wherein metal plates parallel to said windings of said power feed sections are provided and each configured to prevent a current from flowing therethrough in a form of a loop.

12. The apparatus as claimed in claim 11, wherein said metal plates each have a comb-like configuration.

* * * * *